US005936356A

United States Patent [19]

Brault

[11] Patent Number: 5,936,356

[45] Date of Patent: Aug. 10, 1999

[54] FLUORESCENT LAMP FLASHING CIRCUIT AND CONTROL

[75] Inventor: Pierre Brault, St-Jude, Canada

[73] Assignee: Interballast Inc., St.-Mathieu-de-Beloeil, Canada

[21] Appl. No.: 09/158,535

[22] Filed: Sep. 22, 1998

[51] Int. Cl.[6] ..... H05B 37/00

[52] U.S. Cl. ..... 315/231; 315/200 A; 315/200 R; 315/101; 315/244; 315/DIG. 4

[58] Field of Search ..... 315/200 A, 200 R, 315/231, 237, 240, 241 R, 101, 105, DIG. 2, DIG. 4, DIG. 5, 244

[56] References Cited

U.S. PATENT DOCUMENTS

| | | | |
|---|---|---|---|
| 3,710,185 | 1/1973 | Switsen | 315/240 |
| 5,111,115 | 5/1992 | Ball et al. | 315/239 |
| 5,616,992 | 4/1997 | Bildgen | 315/209 T |

*Primary Examiner*—Haissa Philogene
*Attorney, Agent, or Firm*—Marvin S. Townsend

[57] ABSTRACT

A fluorescent lamp flashing circuit is comprised of a fluorescent lamp to which an alternating supply voltage source is connected through a series connected loading reactance device which provides current limiting. The heaters of the fluorescent lamp are independently fed. A switching device disconnects and reconnects the alternating supply voltage at a predetermined frequency rate which is determined by a control circuit which controls a switching device. When the switching device is closed, the fluorescent lamp is bypassed through a full wave rectifier bridge and the reactance device is connected in parallel with the supply voltage source and with a bleeding resistance to load the bridge and to form a resonant circuit to maintain the loading reactance device constant and permitting an energy exchange between the supply voltage source and the loading reactance device in a resonant mode thereby maintaining a sine wave form and minimizing loss. When the switching device is in a non-conductive open state, the lamp is "on".

15 Claims, 3 Drawing Sheets

LAMP CURRENT PATH
LAMP SHORTING PATH

FLUORESCENT LAMP FLASHING CIRCUIT AND CONTROL

TECHNICAL FIELD

The present invention relates to a reactance fluorescent lamp flashing circuit provided with a controller capable of controlling a switching device to adjust the pulsating flashing rate of the fluorescent lamp and the intensity thereof without affecting the intended life of the lamp.

BACKGROUND ART

For a long time it has been possible to produce a flashing action with incandescent lamps and neon tube lamps. To produce a similar flashing action with fluorescent lamps has not been practical because the ballast driving the lamp reduces significantly the life of that fluorescent lamp. For this reason, fluorescent lamps are not operated in flashing modes and their benefits can therefore not be utilized for certain applications wherein large markets for such lamps could exist.

SUMMARY OF INVENTION

It is a feature of the present invention to provide a fluorescent lamp flashing circuit that permits a flashing action with fluorescent lamps without the lamp life reduction effect.

Another feature of the present invention is to provide a fluorescent lamp flashing circuit which also allows a dimming action of the fluorescent lamp by using an appropriate control circuit which controls a switching element.

Another feature of the present invention is to provide a fluorescent lamp flashing circuit which is simple in construction and reliable and which prolongs the life of fluorescent lamps when used in a flashing mode.

According to a broad aspect of the present invention there is provided fluorescent lamp flashing circuit which comprises a fluorescent lamp to which is connected a heater voltage. An alternating current supply voltage source is connected to the fluorescent lamp through a series connected loading reactance device which provides current limiting. A switching device is provided to disconnect and reconnect the alternating current supply voltage source from the fluorescent lamp at a predetermined frequency rate. A control circuit controls the operation of the switching device to produce the predetermined frequency rate. A bypass full wave rectifier bridge is associated with the switching device to connect the loading reactance device in parallel with the supply voltage source and with a bleeding resistance to load the bridge and form a resonance circuit to maintain the loading reactance device constant and permitting an energy exchange between the supply voltage source and the loading reactance device in a resonant mode thereby maintaining a sine wave form and minimizing loss when the switching device is in a "closed" conductive state.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
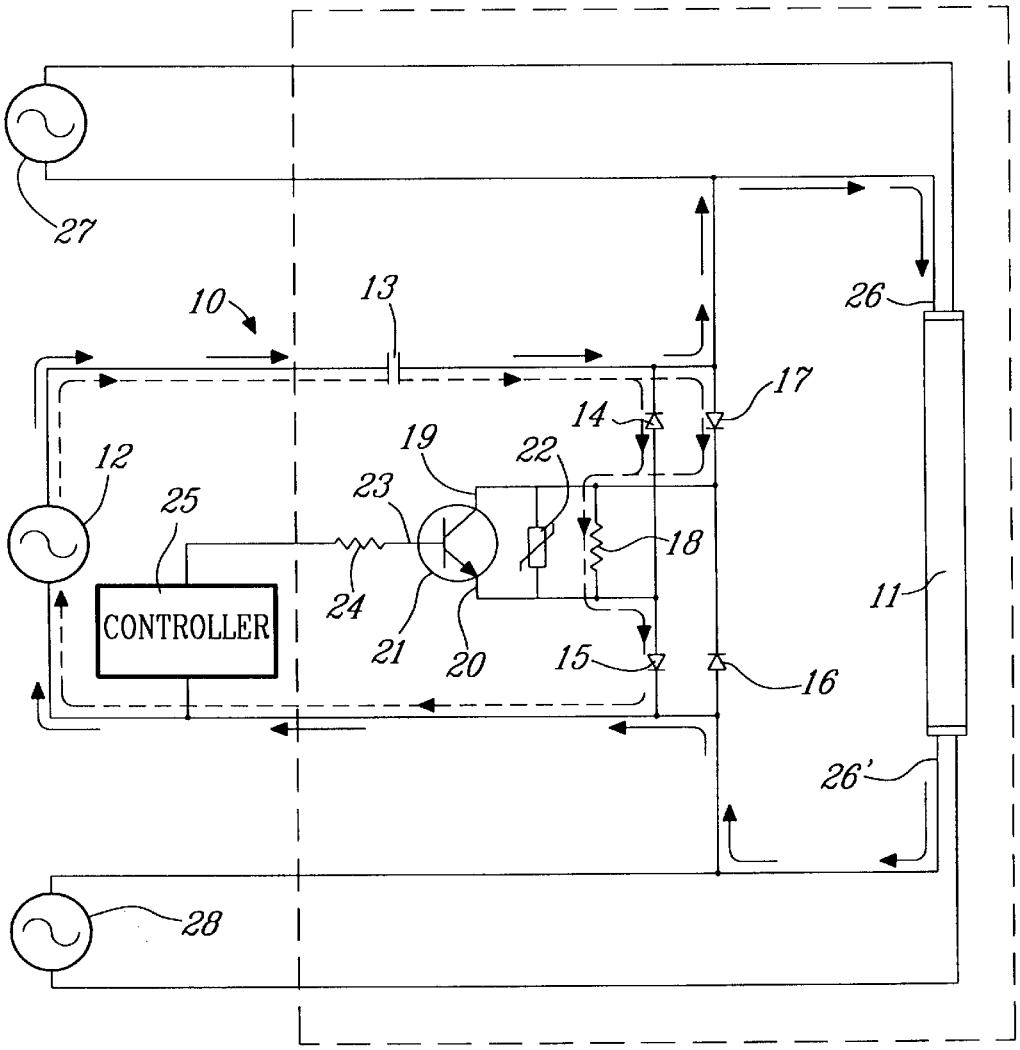
FIG. 1 is a schematic diagram showing the fluorescent lamp flashing circuit of the present invention as connected to a single fluorescent lamp.

Referring now to the drawings, and more particularly to FIG. 1, there is shown generally at 10 the fluorescent lamp flashing circuit of the present invention. As hereinshown the circuit 10 is connected to a fluorescent lamp 11 and the alternating voltage source 12 is coupled to the fluorescent lamp 11 via a capacitive reactance 13, which acts as a lamp current limiting device. A full wave rectifier bridge is provided by diodes 14, 15, 16 and 17 and its purpose will be described hereinbelow. A bleeding resistor 18 is connected between the collector 19 and emitter 20 of the switching transistor 21 and its purpose is to load the full wave rectifier bridge and to discharge the circuit stray capacitance and the capacitance that is represented by a varistor 22 which is also connected in parallel with the bleeding resistor 18. The varistor 22 acts as a high voltage transient suppressing device to protect the switching transistor 21 from high voltage transient at switching time.

The switching transistor 21 is the active switching element in the circuit and it may be a Bipolar or a Mosfet type transistor.

When a high level signal voltage is applied to the base or gate 23 of transistor 21 via the current limiting resistor 24, the transistor becomes in full conductive "closed" state thereby shorting the fluorescent lamp 11 via the diode bridge. This shorting takes place through diode 14 or 17 depending on voltage phase of the AC source, then across the parallel connection of the transistor 21, the varistor 22 and the bleeding resistance 18 and the return to the supply source via diode 15 or 16 depending on the voltage phase of the AC source. This action removes the high voltage source 12 from across the fluorescent lamp which is therefore turned OFF. In this state, the switching circuit 10 places the capacitor 13 in parallel with the AC source through the above-mentioned conductive path. This forms a resistance circuit with the AC source 12 keeping the loading capacitance 13 constant. This constant loading capacitance permits an energy exchange between the AC source 12 and the capacitor 13 in a resonance mode keeping a sine wave form and minimizing loss.

The switching transistor 21 is operated by a control circuit 25 which feeds control signal pulses to the base 23 of the transistor to render the transistor conductive and non-conductive. When the controller signal pulse is low, the transistor 21 does not conduct and becomes "open" as a switching element and only a very low current flows across the diode bridge via the bleeding resistor 18. At this point the high voltage is applied across the lamp 11 which is therefore turned ON. In this switching mode, the capacitive reactance or capacitor 13 is connected directly to terminal 26 of the fluorescent lamp 11 wherein the voltage can energize the lamp and the return path is provided from the second end 26' of the fluorescent lamp to the AC source. Accordingly, the fluorescent lamp is connected in series with the capacitive reactance and the AC supply source 12.

It is pointed out that the switching transistor has no effect on the lamp heaters (not shown) which are heated permanently by respective AC supply sources 27 and 28.

The control circuit 25 may be adjusted to produce switching pulses which have a predetermined characteristic whereby to produce a predetermined flashing or frequency rate for the fluorescent lamp. At very low frequency of the controller, the circuit produces the flashing effect, with the time of the "on" and the "off" periods being adjustable (Duty Cycle). When the frequency of the controller is approximately 120 Hertz and more, the duty cycle ration produces a dimming effect. By adjusting the "on" and "off" times of the switching pulses, we can control the duty cycle of the switch such that the "on" and "off" switching periods can vary. For example, if the time that the switching transistor is "on" is equal to the time that it is "off", then the fluorescent lamp will dim to about 50% of its full intensity. If the "on" period is, for example, 75% and the "off" switching period 25%, then the dimming reduction would only be 25% of full intensity.

It is further pointed out that although the method as above-described uses a parallel tune current feed inverter as a high frequency AC source, it is also possible to use this method with a voltage feed series resonance inverter by substituting the capacitive reactance element 13 with an inductive reactance element (not shown).

Figure 2:
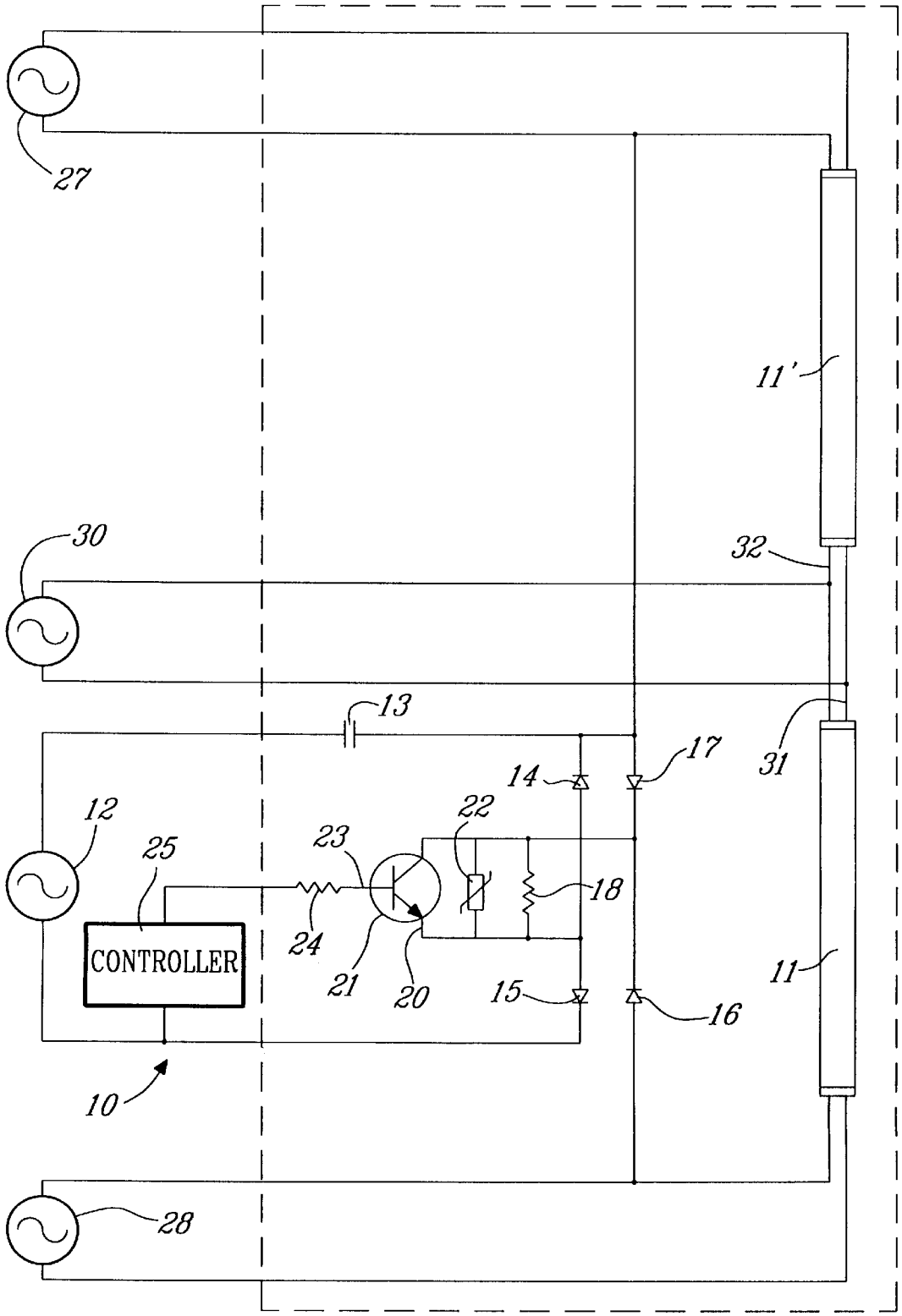
FIG. 2 is a schematic diagram similar to FIG. 1 but illustrating the circuit as connected to two series-connected fluorescent lamps.

With reference now to FIG. 2, it can be seen that the fluorescent lamp flashing circuit 10 of the present invention can also be adapted to control two fluorescent lamps 11 and 11' connected in series with one another. The flashing circuit 10 operates in the same manner as with a single fluorescent lamp as shown in FIG. 1 but with the difference that an additional AC source 30 is provided to supply the common heaters 31 and 32 of the two series-connected fluorescent lamps and which are heated permanently, as above-described.

Figure 3:
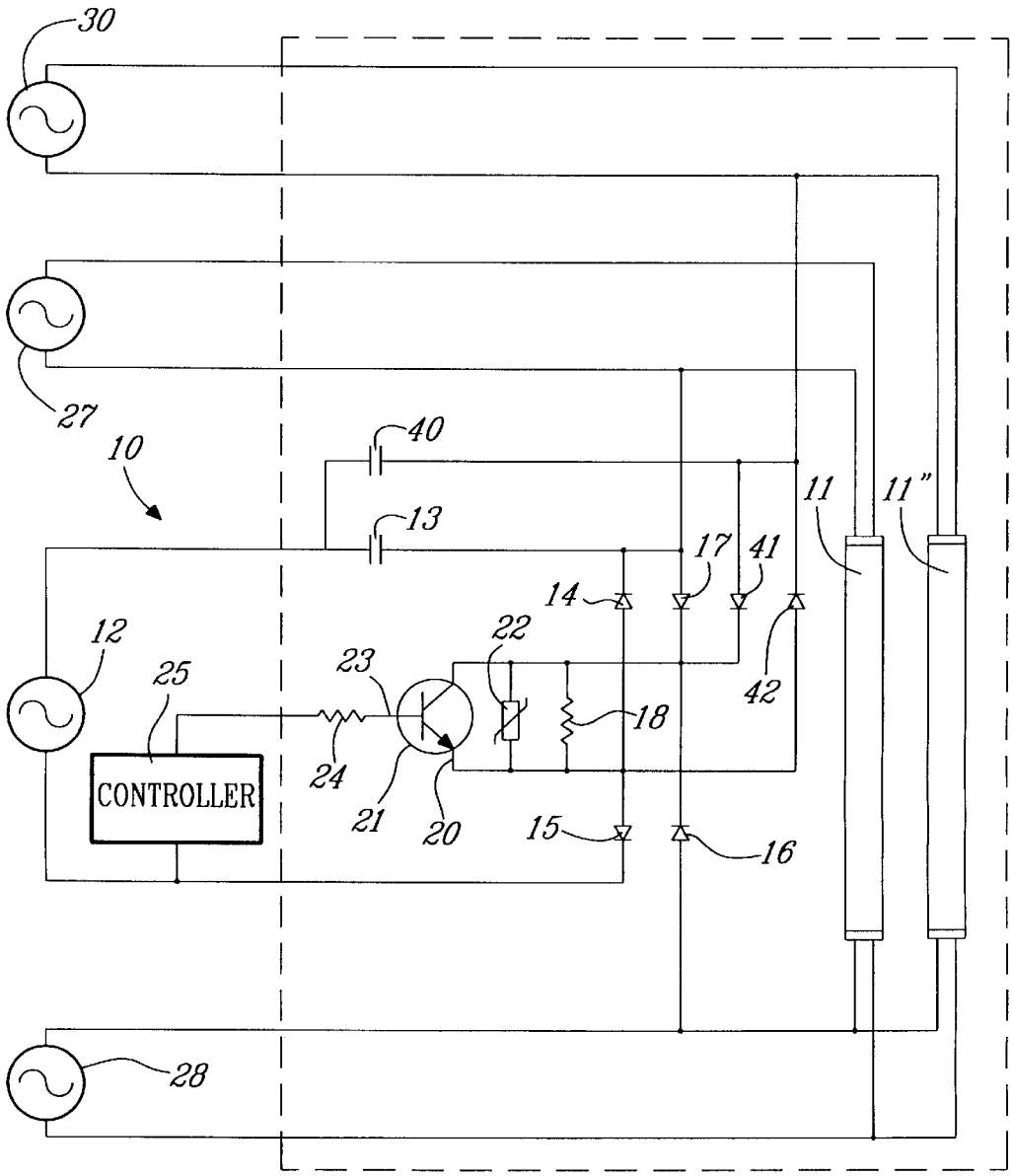
FIG. 3 is a schematic view similar to FIG. 1 but showing the circuit of the present invention as connected to two parallel connected fluorescent lamps.

With reference to FIG. 3, there is shown the fluorescent lamp flashing circuit 10 of the present invention as modified to operate two fluorescent lamps 11 and 11" connected in parallel. In this particular configuration, the alternating voltage source 12 is coupled to the fluorescent lamp 11" via another capacitive reactance 40 with both capacitances 13 and 40 acting as lamp current limiting devices. Since diodes 15 and 16 are the low side part of the rectifier bridge common to both lamps, the full wave rectifier bridge for lamp 11 is therefore comprised by diodes 14, 17 (high side) and 15, 16 (low side). The full wave rectifier bridge for lamp 11" is therefore comprised by diodes 41, 42 (high side) and 15, 16 (low side). The bleeding resistance 18 loads both bridges and discharges the circuit stray capacitance and the capacitance that is represented by varistor 22, as previously described, when the switch is in a non-conductive open state. When the high level switching pulse is provided by the controller 25 to the base 23 of the transistor 21 via the limiting resistor 24, the transistor becomes in full conductive state "closed", shorting both fluorescent lamps 11 and 11" via their respective diode bridges. This action removes the high voltage across both lamps which are turned "off". The switching transistor then places both capacitors 13 and 40 in parallel with the AC source 12 to again form a resonance circuit as previously described. Accordingly, the flashing circuit operates in the same fashion but controlling two parallel connected fluorescent lamps simultaneously.

Those skilled in the art will appreciate that the conception, upon which this disclosure is based, may readily be utilized as a basis for modifying the present circuit for carrying out the several purposes of the present invention. It is important therefore, that the claims be regarded as including such equivalent constructions insofar as they do not depart from the spirit and scope of the present invention. It is therefore within the ambit of the present invention to cover any obvious modifications and the use equivalents.

I claim:

1. A fluorescent lamp flashing circuit comprising a fluorescent lamp to which is connected a heater voltage, an alternating current supply voltage source connected to said fluorescent lamp through a series connected loading reactance device which provides current limiting, a switching device to disconnect and reconnect said alternating current supply voltage source from said fluorescent lamp at a predetermined frequency rate, a control circuit to control the operation of said switching device to produce said predetermined frequency rate, and a bypass full wave rectifier bridge associated with said switching device to connect said loading reactance device in parallel with said supply voltage source and with a bleeding resistance to load said bridge and form a resonance circuit to maintain said loading reactance device constant and permitting an energy exchange between said supply voltage source and said loading reactance device in a resonant mode thereby maintaining a sine wave form and minimizing loss when said switching device is in a "closed" conductive state.

2. A fluorescent lamp flashing circuit as claimed in claim 1 wherein a variable resistance is connected in parallel across said switching device and said bleeding resistance, said bleeding resistance acting as a load for said rectifier bridge and discharging stray capacitance.

3. A fluorescent lamp flashing circuit as claimed in claim 2 wherein said variable resistance is a varistor which acts as a high voltage transient suppressing device to protect said switching device from high voltage transients when said switching device is operated.

4. A fluorescent lamp flashing circuit as claimed in claim 3 wherein said switching device is a switching transistor, said control circuit being connected to a base of said transistor.

5. A fluorescent lamp flashing circuit as claimed in claim 4 wherein said control circuit is preset to produce switching pulses to said base of said transistor through a current limiting resistor to control the "on" and "off" periods of said switching device to adjust the flashing rate of said fluorescent lamp, said control circuit also controlling the dimming of said fluorescent lamp.

6. A fluorescent lamp flashing circuit as claimed in claim 4 wherein said switching transistor is a Bipolar or Mosfet type transistor.

7. A fluorescent lamp flashing circuit as claimed in claim 1 wherein said reactance device is a capacitive reactance.

8. A fluorescent lamp flashing circuit as claimed in claim 2 wherein said heater voltage supply is comprised by a pair of alternating current sources independent from said alternating supply voltage source.

9. A fluorescent lamp flashing circuit as claimed in claim 8 wherein there are two fluorescent lamps connected in series with one another, there being an additional heater voltage supply connected to a common heater of both said fluorescent lamps.

10. A fluorescent lamp flashing circuit as claimed in claim 8 wherein there are two fluorescent lamps connected in parallel, said alternating supply voltage source being connected to both said fluorescent lamps through a respective one of a pair of said series connected loading reactance device, there being two of said full wave rectifier bridge connected to a respective one of said fluorescent lamps, both said fluorescent lamps being disconnected and reconnected from said alternating supply voltage source by said switching device.

11. A fluorescent lamp flashing circuit as claimed in claim 10 wherein said variable resistance is a varistor which acts as a high voltage transient suppressing device to protect said switching device from high voltage transients when said switching device is operated.

12. A fluorescent lamp flashing circuit as claimed in claim 11 wherein said switching device is a switching transistor, said control circuit being connected to a base of said transistor.

13. A fluorescent lamp flashing circuit as claimed in claim 12 wherein said control circuit is preset to produce switching pulses to said base of said transistor through a current limiting resistor to control the "on" and "off" periods of said switching device to adjust the flashing rate of said fluorescent lamp, said control circuit also controlling the dimming of said fluorescent lamp.

14. A fluorescent lamp flashing circuit as claimed in claim 12 wherein said switching transistor is a Bipolar or Mosfet type transistor.

15. A fluorescent lamp flashing circuit as claimed in claim 10 wherein said reactance device is a capacitive reactance.

* * * * *